US011156391B2

(12) United States Patent
Hatanaka et al.

(10) Patent No.: US 11,156,391 B2
(45) Date of Patent: Oct. 26, 2021

(54) REFRIGERATION CYCLE APPARATUS

(71) Applicant: Mitsubishi Electric Corporation, Tokyo (JP)

(72) Inventors: Kensaku Hatanaka, Tokyo (JP); Yuji Motomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 113 days.

(21) Appl. No.: 15/551,966

(22) PCT Filed: Apr. 20, 2015

(86) PCT No.: PCT/JP2015/062002

§ 371 (c)(1),
(2) Date: Aug. 18, 2017

(87) PCT Pub. No.: WO2016/170575

PCT Pub. Date: Oct. 27, 2016

(65) Prior Publication Data

US 2018/0073782 A1 Mar. 15, 2018

(51) Int. Cl.
*F25B 13/00* (2006.01)
*F25B 6/02* (2006.01)
(Continued)

(52) U.S. Cl.
CPC ..... *F25B 13/00* (2013.01); *F25B 5/02* (2013.01); *F25B 6/02* (2013.01); *F25B 25/005* (2013.01);
(Continued)

(58) Field of Classification Search
CPC ..... F25B 13/00; F25B 2313/003; F25B 2313/006; F25B 2313/0231;
(Continued)

(56) References Cited

U.S. PATENT DOCUMENTS 4,644,756 A * 2/1987 Sugimoto ..... F24F 3/065 62/160
2011/0113802 A1 5/2011 Wakamoto et al.
(Continued)

FOREIGN PATENT DOCUMENTS

CN 102016442 A 4/2011
EP 2 284 456 A1 2/2011
(Continued)

OTHER PUBLICATIONS

Davis Air Conditioning & Heating, The Reason Air Conditioner Capacity Is Measured in Tons, Jul. 25, 2013 (Year: 2013).*
(Continued)

*Primary Examiner* — Larry L Furdge
*Assistant Examiner* — Chang H Park
(74) *Attorney, Agent, or Firm* — Posz Law Group, PLC

(57) ABSTRACT

A refrigeration cycle apparatus includes a heat source unit configured to supply refrigerant, a first distribution unit and a second distribution unit respectively connected to the heat source unit, and a distribution pipe located between the heat source unit and the first distribution unit and the second distribution unit for distributing the refrigerant flowing from the heat source unit into the first distribution unit and the second distribution unit. Further, the first distribution unit and the second distribution unit individually include a heat exchanger configured to serve as a condenser. Further, if the refrigerant flowing through the distribution pipe is unevenly distributed into the first distribution unit and the second distribution unit, a degree of subcooling at an outlet of the heat exchanger of one of the first distribution unit and the second distribution unit of which the distributed refrigerant is of high quality is increased.

8 Claims, 6 Drawing Sheets

(51) Int. Cl.
*F25B 5/02* (2006.01)
*F25B 25/00* (2006.01)
*F25B 49/02* (2006.01)

(52) U.S. Cl.
CPC ..... *F25B 49/02* (2013.01); *F25B 2313/003* (2013.01); *F25B 2313/006* (2013.01); *F25B 2313/0231* (2013.01); *F25B 2313/0233* (2013.01); *F25B 2313/0272* (2013.01); *F25B 2313/02741* (2013.01); *F25B 2313/02742* (2013.01); *F25B 2313/0314* (2013.01); *F25B 2500/24* (2013.01); *F25B 2600/2513* (2013.01); *F25B 2700/21163* (2013.01)

(58) Field of Classification Search
CPC ..... F25B 2313/0233; F25B 2313/0272; F25B 2313/02741; F25B 2313/02742; F25B 2313/0314; F25B 25/005; F25B 2600/2513; F25B 49/02; F25B 5/02; F25B 6/02; F25B 2341/0661; F25B 2339/047; F25B 2700/21163; F25B 2600/05
See application file for complete search history.

(56) References Cited

U.S. PATENT DOCUMENTS

| | | | | |
|---|---|---|---|---|
| 2014/0150483 | A1* | 6/2014 | Takayama | F25B 13/00 62/160 |
| 2015/0047379 | A1* | 2/2015 | Honda | F25B 13/00 62/125 |

FOREIGN PATENT DOCUMENTS

| | | | | |
|---|---|---|---|---|
| EP | 2284456 | A1 * | 2/2011 | F24F 3/06 |
| EP | 2 899 477 | A1 | 7/2015 | |
| EP | 2899477 | A1 * | 7/2015 | F24F 3/065 |
| EP | 2 963 353 | A1 | 1/2016 | |
| JP | H05-172432 | A | 7/1993 | |
| JP | 2616524 | B2 | 3/1997 | |
| JP | 2006-336947 | A | 12/2006 | |
| JP | 2006336947 | A * | 12/2006 | |
| WO | 2014/045358 | A1 | 3/2014 | |
| WO | 2014/132433 | A1 | 9/2014 | |
| WO | 2014/141381 | A1 | 2/2017 | |

OTHER PUBLICATIONS

Pete Hoffman, Air Conditioning—Evaporator, 2006 (Year: 2006).*
John Tomczyk, Analyzing Refrigerant Flow Problems, Jan. 8, 2004, the NEWS (Year: 2004).*
John Tomczyk, The Symptoms of a Restricted TXV, Jan. 9, 2017, the NEWS (Year: 2017).*
International Search Report of the International Searching Authority dated Jun. 23, 2015 for the corresponding International application No. PCT/JP2015/062002 (and English translation).
Extended European Search Report dated Sep. 28, 2018 issued in corresponding EP patent application No. 15889816.3.
Office Action dated Jul. 4, 2019 issued in corresponding CN patent application No. 201580078815.4 (and English translation).

* cited by examiner

REFRIGERATION CYCLE APPARATUS

CROSS REFERENCE TO RELATED APPLICATION

This application is a U.S. national stage application of International Application No. PCT/JP2015/062002, filed on Apr. 20, 2015, the contents of which are incorporated herein by reference.

TECHNICAL FIELD

The present invention relates to a refrigeration cycle apparatus including a plurality of distribution units.

BACKGROUND

In the past, a multi-air-conditioning apparatus for a building in which a plurality of indoor units are connected to a single outdoor unit via a plurality of distribution units (relay units) has been known (Patent Literature 1, for example).

PATENT LITERATURE

Patent Literature 1: Japanese Patent No. 2616524

In general, a distribution pipe such as a Y-shaped distribution pipe is used to distribute refrigerant from an outdoor unit to a plurality of distribution units. Herein, if the Y-shaped distribution pipe is inclined with respect to the horizontal when the refrigerant flowing through the Y-shaped distribution pipe is in a two-phase gas-liquid state, the refrigerant is distributed into the respective distribution units with an uneven proportion of gas and liquid. Consequently, the distribution units have uneven air-conditioning capacities, with one of the distribution units failing to supply necessary air-conditioning capacity.

SUMMARY

The present invention has been made to solve the above-described issue, and aims to provide a refrigeration cycle apparatus capable of correcting the unevenness in capacity between the plurality of distribution units due to the inclination of the distribution pipe.

A refrigeration cycle apparatus according to an embodiment of the present invention includes a heat source unit configured to supply refrigerant, a first distribution unit and a second distribution unit respectively connected to the heat source unit, and a distribution pipe located between the heat source unit and the first distribution unit and the second distribution unit for distributing the refrigerant flowing from the heat source unit into the first distribution unit and the second distribution unit. The first distribution unit and the second distribution unit individually include a heat exchanger configured to serve as a condenser. In a case where the refrigerant flowing through the distribution pipe is unevenly distributed into the first distribution unit and the second distribution unit, a degree of subcooling at an outlet of the heat exchanger of one of the first distribution unit and the second distribution unit of which the distributed refrigerant is of high quality is increased.

According to the refrigeration cycle apparatus of an embodiment of the present invention, even if the refrigerant is unevenly distributed into the plurality of distribution units owing to a factor such as the inclination of the distribution pipe, the unevenness in capacity between the plurality of distribution units is corrected by increasing the degree of subcooling at the outlet of the heat exchanger of the distribution unit of which the distributed refrigerant is of high quality.

DETAILED DESCRIPTION

A refrigeration cycle apparatus of the present invention will be described below with reference to the drawings. Configurations and so forth described below are illustrative, and a refrigeration cycle apparatus of the present invention is not limited to the following configurations. Further, in the respective drawings, identical or similar members or parts are assigned with identical signs, or the assignment of signs to those members or parts is omitted. Further, redundant or similar descriptions will be simplified or omitted as appropriate.

Embodiment 1

Figure 1:
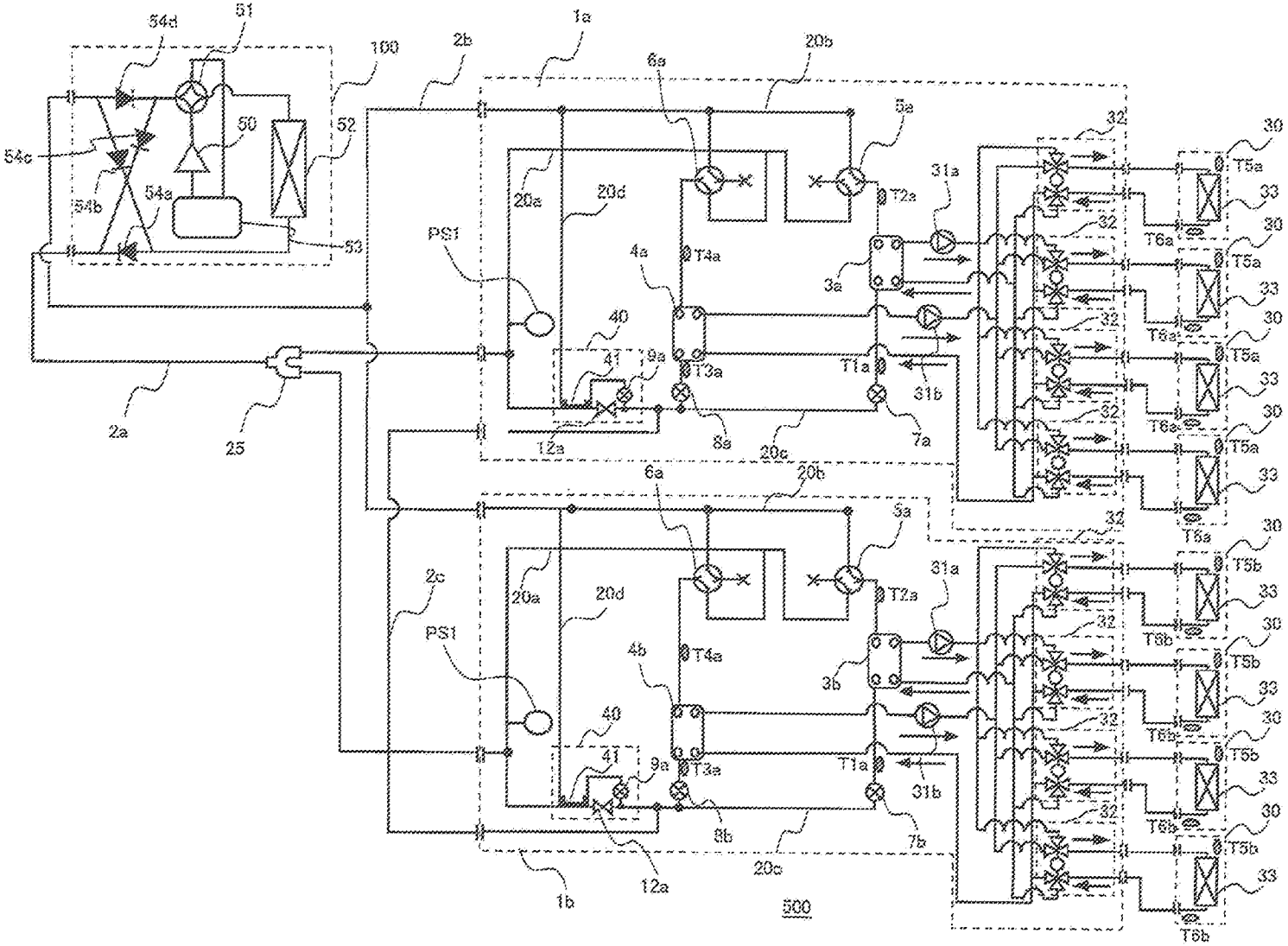
FIG. 1 is a refrigerant circuit diagram of a refrigeration cycle apparatus in Embodiment 1.

FIG. 1 is a refrigerant circuit diagram of a refrigeration cycle apparatus 500 in Embodiment 1 of the present invention. The refrigeration cycle apparatus 500 of Embodiment 1 is a multi-air-conditioning apparatus for a building employed for air-conditioning (cooling and heating) of a plurality of utilization units 30. The refrigeration cycle apparatus 500 of Embodiment 1 includes a heat source unit 100, a first distribution unit 1*a*, a second distribution unit 1*b*, and the plurality of utilization units 30 connected to the first distribution unit 1*a* and the second distribution unit 1*b*. As illustrated in FIG. 1, the heat source unit 100 and the first distribution unit 1*a* and the second distribution unit 1*b* are connected by a high-pressure refrigerant pipe 2*a* and a low-pressure refrigerant pipe 2*b*. Further, the first distribution unit 1*a* and the second distribution unit 1*b* are connected by an intermediate-pressure refrigerant pipe 2*c*. Further, the high-pressure refrigerant pipe 2*a* is provided with a distribution pipe 25 that distributes high-pressure refrigerant from the heat source unit 100 into the first distribution unit 1*a* and the second distribution unit 1*b*. In the following, configurations of respective devices and operation modes will be described.

[Heat Source Unit 100]

The heat source unit 100 is an outdoor unit installed outdoors. The heat source unit 100 includes a compressor 50 for compressing refrigerant into high-temperature, high-pressure refrigerant and transporting the compressed refrigerant into a refrigerant passage, a refrigerant flow switching device 51, such as a four-way valve, for switching a flow of the refrigerant in accordance with the operation mode of the heat source unit 100, a heat source-side heat exchanger 52 serving as an evaporator or a condenser, and an accumulator 53 that stores excess refrigerant generated due to a difference in the operation mode or excess refrigerant resulting from a transitional change in the operation. The heat source unit 100 further includes a controller 90 (FIG. 5) that controls the entire refrigeration cycle apparatus 500.

Further, refrigerant pipes of the heat source unit 100 are provided with check valves 54*a*, 54*b*, 54*c*, and 54*d* for allowing the refrigerant to flow only in one direction. With these check valves 54*a*, 54*b*, 54*c*, and 54*d* installed in the heat source unit 100, it is possible to fix the flow of the refrigerant flowing into the first distribution unit 1*a* and the second distribution unit 1*b* to one direction, irrespective of the operation mode of the utilization units 30.

[First Distribution Unit 1*a* and Second Distribution Unit 1*b*]

Since the first distribution unit 1*a* and the second distribution unit 1*b* have the same internal structure, the first distribution unit 1*a* will be described as a representative. The first distribution unit 1*a* includes intermediate heat exchangers 3*a* and 4*a*. The intermediate heat exchangers 3*a* and 4*a* exchange heat between the heat source-side refrigerant and a secondary-side heat medium on the use side, such as water or antifreeze, for example, and transfer the cooling energy or the heating energy of the heat source-side refrigerant generated by the heat source unit 100 to the secondary-side heat medium. Each of the intermediate heat exchangers 3*a* and 4*a* therefore serves as a condenser (radiator) when supplying a heating energy medium to any of the utilization units 30 performing a heating operation, and serves as an evaporator when supplying a cooling energy medium to any of the utilization units 30 performing a cooling operation.

The intermediate heat exchanger 3*a* is a heat exchanger mainly for heating provided between a first expansion device 7*a* and a first refrigerant flow switching device 5*a* and serving as a condenser in a cooling and heating mixed operation mode. Opposite sides of a refrigerant passage connected to the intermediate heat exchanger 3*a* are installed with temperature sensors T1*a* and T2*a* each of which detects an outlet temperature of the refrigerant. Further, the intermediate heat exchanger 4*a* is a heat exchanger mainly for cooling provided between a second expansion device 8*a* and a second refrigerant flow switching device 6*a* and serving as an evaporator in the cooling and heating mixed operation mode. Opposite sides of a refrigerant passage connected to the intermediate heat exchanger 4*a* are installed with temperature sensors T3*a* and T4*a* each of which detects an outlet temperature of the refrigerant.

Each of the first expansion device 7*a* and the second expansion device 8*a* is formed of a device such as an electronic expansion valve, for example, and has an opening degree variably controlled by the controller 90. Further, each of the first refrigerant flow switching device 5*a* and the second refrigerant flow switching device 6*a* is a device such as a four-way valve, for example, and switches refrigerant passages to cause each of the intermediate heat exchangers 3*a* and 4*a* to serve as the condenser or the evaporator in accordance with the operation mode of the utilization units 30 under the control of the controller 90. The first refrigerant flow switching device 5*a* and the second refrigerant flow switching device 6*a* are installed downstream of the intermediate heat exchanger 3*a* and the intermediate heat exchanger 4*a*, respectively, in a cooling only operation mode.

Further, the first refrigerant flow switching device 5*a* and the second refrigerant flow switching device 6*a* are switchably connected to the high-pressure refrigerant pipe 2*a* and the low-pressure refrigerant pipe 2*b* connected to the heat source unit 100. A refrigerant passage allowing the first refrigerant flow switching device 5*a* and the second refrigerant flow switching device 6*a* to communicate with the high-pressure refrigerant pipe 2*a* will be referred to as the distribution unit high-pressure passage 20*a*. A refrigerant passage allowing the first refrigerant flow switching device 5*a* and the second refrigerant flow switching device 6*a* to communicate with the low-pressure refrigerant pipe 2*b* will be referred to as the distribution unit low-pressure passage 20*b*. A passage allowing the first expansion device 7*a* and the second expansion device 8*a* to communicate with the high-pressure refrigerant pipe 2*a* will be referred to as the distribution unit intermediate-pressure passage 20*c*. The distribution unit high-pressure passage 20*a* is provided with a high pressure-side pressure sensor PS1.

Further, the distribution unit low-pressure passage 20*b* and the distribution unit intermediate-pressure passage 20*c* are connected by a distribution unit bypass passage 20*d*. The distribution unit intermediate-pressure passage 20*c* is provided with an HIC circuit 40. The HIC circuit 40 includes an opening and closing valve 12*a*, a third expansion device 9*a*, and a refrigerant-side intermediate heat exchanger 41. The HIC circuit 40 is provided to divide the refrigerant flowing through the distribution unit intermediate-pressure passage 20*c* in the cooling only operation mode to allow a part of the divided refrigerant to pass through the third expansion device 9*a* and merge with the refrigerant flowing through the distribution unit low-pressure passage 20*b*. The refrigerant-side intermediate heat exchanger 41 of the HIC circuit 40 exchanges heat between the refrigerant flowing through the distribution unit intermediate-pressure passage 20*c* and the refrigerant divided from the refrigerant flowing through the distribution unit intermediate-pressure passage 20*c* and reduced in pressure through the third expansion device 9*a*.

The distribution unit intermediate-pressure passage 20*c* of the first distribution unit 1*a* is connected to the distribution unit intermediate-pressure passage 20*c* of the second distribution unit 1*b* via the intermediate-pressure refrigerant pipe 2*c*. The intermediate-pressure refrigerant pipe 2*c* thus connects the distribution unit intermediate-pressure passage 20*c* of the first distribution unit 1*a* and the distribution unit intermediate-pressure passage 20*c* of the second distribution unit 1*b* to each other, to thereby allow the exchange of the refrigerant between the first distribution unit 1*a* and the second distribution unit 1*b* in accordance with the operation mode.

Further, the first distribution unit 1*a* is provided with heat medium flow switching devices 32 for the respective utilization units 30 to transport the secondary-side heat medium to the utilization units 30. Each of the heat medium flow switching devices 32, which is formed of two three-way valves configured as one unit, switches the passage of the heat medium between the intermediate heat exchanger 3*a* and the intermediate heat exchanger 4*a*, and controls the flow rate of the heat medium flowing into each branch. The number of the heat medium flow switching devices 32 to be provided depends on the number of the installed utilization units 30 (four in this case), and the heat medium flow switching devices 32 may be connected to one another. Each of the heat medium flow switching devices 32 includes therein one port connected to the intermediate heat exchanger 3*a*, one port connected to the intermediate heat exchanger 4*b*, and one port connected to a use-side heat exchanger 33.

Further, the heat medium flow switching device 32 is configured to control the opening area of a pipe to control the flow rate of the heat medium flowing through the pipe. Based on the temperature of the heat medium flowing into the corresponding utilization unit 30 and the temperature of the heat medium flowing from the utilization unit 30, the heat medium flow switching device 32 controls the amount of the heat medium flowing into the utilization unit 30 to provide the utilization unit 30 with an optimal amount of the heat medium according to an air-conditioning load. Herein, if the utilization unit 30 does not require the air-conditioning load, such as stop or thermo-off (stop of a device such as a fan in the utilization unit 30), or if it is desired to block the passage of the heat medium for a maintenance work and so forth, it is possible to stop the supply of the heat medium to the utilization unit 30 by fully closing the heat medium flow switching device 32.

Further, in the first distribution unit 1*a*, heat medium transport devices 31*a* and 31*b* corresponding to the intermediate heat exchangers 3*a* and 4*a*, respectively, are provided to transport the heat medium to the respective utilization units 30. The heat medium transport devices 31*a* and 31*b*, each of which is a pump, for example, are provided to heat medium pipes between the intermediate heat exchangers 3*a* and 4*a* and the heat medium flow switching devices 32, and the flow rate of the heat medium is controlled in accordance with the magnitude of the load required by the utilization units 30.

[Utilization Units 30]

Each of the utilization units 30 is an indoor unit (fan coil unit) installed as concealed in or suspended from the ceiling of an indoor space or hung on a surface of a wall of the indoor space, for example, to heat or cool the indoor space in accordance with the set operation mode and temperature. The utilization unit 30 includes the use-side heat exchanger 33 that exchanges heat between indoor air and the heat medium flowing in from the first distribution unit 1*a* and the second distribution unit 1*b*. The utilization unit 30 further includes a temperature sensor T5*a* that detects the temperature of air to be suctioned into the utilization unit 30 and a temperature sensor T6*a* that detects the temperature of the heat medium at an outlet of the utilization unit 30.

[Operation Mode]

As operation modes, each of the first distribution unit 1*a* and the second distribution unit 1*b* operates a heating only operation mode in which all driven utilization units 30 perform the heating operation, a cooling only operation mode in which all driven utilization units 30 perform the cooling operation, and a mixed operation mode in which one or more of the utilization units 30 perform the cooling operation and one or more of the utilization units 30 perform the heating operation. Further, the mixed operation mode includes a cooling main operation mode in which the load of the utilization units 30 performing the cooling operation is large and a heating main operation mode in which the load of the utilization units 30 performing the heating operation is large. Operations of the refrigerant and the secondary-side heat medium in the respective operation modes will be described below. Since the first distribution unit 1*a* and the second distribution unit 1*b* are similar to each other in the operations of the refrigerant and the secondary-side heat medium, the operations in the first distribution unit 1*a* will be described as a representative.

[Cooling Only Operation Mode]

The flow of the refrigerant in the cooling only operation mode will first be described. Low-temperature, low-pressure gas refrigerant flows into the compressor 50, and is discharged as high-temperature, high-pressure gas refrigerant. The discharged high-temperature, high-pressure gas refrigerant flows into the heat source-side heat exchanger 52 and exchanges heat with outdoor air to turn into high-pressure liquid refrigerant, and flows into the high-pressure refrigerant pipe 2*a* from the heat source unit 100. The liquid refrigerant flowing from the high-pressure refrigerant pipe 2*a* into the first distribution unit 1*a* flows into the distribution unit intermediate-pressure passage 20*c* through the fully open opening and closing valve 12*a*. Further, the refrigerant flowing into the distribution unit intermediate-pressure passage 20*c* divides in the HIC circuit 40 to exchange heat with the refrigerant reduced in pressure by the third expansion device 9*a*. Then, the refrigerant expanded through the first expansion device 7*a* and the second expansion device 8*a* flows into the intermediate heat exchangers 3*a* and 4*a* as low-pressure, two-phase gas-liquid refrigerant. In the intermediate heat exchangers 3*a* and 4*a*, the refrigerant then exchanges heat with the secondary-side heat medium, such as water or antifreeze, and evaporates into gas refrigerant. In this process, the respective opening degrees of the first expansion device 7*a* and the second expansion device 8*a* are controlled such that the degree of superheat, which is the temperature difference between an evaporating temperature and an outlet refrigerant temperature of the intermediate heat exchanger 3*a* detected by the temperature sensor T2*a* or an outlet refrigerant temperature of the intermediate heat exchanger 4*a* detected by the temperature sensor T4*a*, equals a target value (2 degrees Celsius, for example).

The refrigerant having turned into the gas refrigerant flows into the first refrigerant flow switching device 5*a* and the second refrigerant flow switching device 6*a*. The first refrigerant flow switching device 5*a* and the second refrigerant flow switching device 6*a* have been switched to cooling by this time. The gas refrigerant passing through the first refrigerant flow switching device 5*a* and the gas refrigerant passing through the second refrigerant flow switching device 6*a* flow into the distribution unit low-pressure passage 20*b*, and are transported to the heat source unit 100 through the low-pressure refrigerant pipe 2*b* and returned to the compressor 50.

The flow of the heat medium in the cooling only operation mode will now be described. As described above, the secondary-side heat medium, such as water or antifreeze, exchanges heat with the low-temperature refrigerant in the intermediate heat exchangers 3*a* and 4*a* to turn into low-temperature secondary-side heat medium. The secondary-side heat medium is then transported to the utilization units 30 by the heat medium transport devices 31*a* and 31*b* connected to the intermediate heat exchangers 3*a* and 4*a*, respectively. The transported secondary-side heat medium flows into the heat medium flow switching devices 32 connected to the respective utilization units 30, and the heat medium flow switching devices 32 adjust the flow rate of the heat medium flowing into the utilization units 30. In this process, the heat medium flow switching devices 32 supply the utilization units 30 with the secondary-side heat medium transported from both of the intermediate heat exchangers 3*a* and 4*a*.

In the use-side heat exchangers 33, the secondary-side heat medium flowing into the utilization units 30 exchanges heat with the indoor air of the indoor space. Thereby, the cooling operation by the utilization units 30 is performed.

The secondary-side heat medium subjected to the heat exchange in the use-side heat exchangers 33 flows into the intermediate heat exchangers 3*a* and 4*a* through the heat medium pipes and the heat medium flow switching devices 32. Then, in the intermediate heat exchangers 3*a* and 4*a*, the refrigerant receives an amount of heat equal to the amount of heat received from the indoor space through the utilization units 30, reducing the temperature of the secondary-side heat medium. Thereafter, the secondary-side heat medium is again transported by the heat medium transport devices 31*a* and 31*b*.

[Heating Only Operation Mode]

The flow of the refrigerant in the heating only operation mode will first be described. Low-temperature, low-pressure refrigerant flows into the compressor 50, and is discharged as high-temperature, high-pressure gas refrigerant. The discharged high-temperature, high-pressure gas refrigerant flows into the high-pressure refrigerant pipe 2*a* from the heat source unit 100. The gas refrigerant flowing from the high-pressure refrigerant pipe 2*a* into the first distribution unit 1*a* divides and flows into the first refrigerant flow switching device 5*a* and the second refrigerant flow switching device 6*a*. The first refrigerant flow switching device 5*a* and the second refrigerant flow switching device 6*a* have been switched to heating by this time. The gas refrigerant passing through the first refrigerant flow switching device 5*a* and the gas refrigerant passing through the second refrigerant flow switching device 6*a* pass through the intermediate heat exchanger 3*a* and the intermediate heat exchanger 4*a*, respectively, to exchange heat with the secondary-side heat medium, such as water or antifreeze.

The refrigerant having turned into high-temperature, high-pressure liquid refrigerant through the heat exchange with the secondary-side heat medium passes through the first expansion device 7*a* and the second expansion device 8*a* to be expanded into intermediate-pressure liquid refrigerant. In this process, the respective opening degrees of the first expansion device 7*a* and the second expansion device 8*a* are controlled such that the degree of subcooling, which is the temperature difference between a condensing temperature obtained from the high pressure-side pressure sensor PS1 and an outlet refrigerant temperature of the intermediate heat exchanger 3*a* detected by the temperature sensor T1*a* or an outlet refrigerant temperature of the intermediate heat exchanger 4*a* detected by the temperature sensor T3*a*, equals a target value (10 degrees Celsius, for example).

The liquid refrigerant passing through the first expansion device 7*a* and the liquid refrigerant passing through the second expansion device 8*a* merge together, and thereafter flow into the distribution unit low-pressure passage 20*b* through the distribution unit bypass passage 20*d*. In this process, the opening and closing valve 12*a* is controlled to be fully closed, and the HIC circuit 40 is used as a bypass. The intermediate-pressure liquid refrigerant flowing into the distribution unit low-pressure passage 20*b* turns into low-temperature, low-pressure two-phase refrigerant, and is transported to the heat source unit 100 through the low-pressure refrigerant pipe 2*b*. The low-temperature, low-pressure two-phase refrigerant transported to the heat source unit 100 flows into the heat source-side heat exchanger 52, exchanges heat with the outdoor air to turn into low-temperature, low-pressure gas refrigerant, and is returned to the compressor 50.

The flow of the heat medium in the heating only operation mode will now be described. As described above, the heat medium, such as water or antifreeze, exchanges heat with the high-temperature, high-pressure refrigerant in the intermediate heat exchangers 3*a* and 4*a* to turn into a high-temperature secondary-side heat medium. The secondary-side heat medium increased in temperature in the intermediate heat exchangers 3*a* and 4*a* is transported to the utilization units 30 by the heat medium transport devices 31*a* and 31*b* connected to the intermediate heat exchangers 3*a* and 4*a*, respectively. The transported secondary-side heat medium flows into the heat medium flow switching devices 32 connected to the respective utilization units 30, and the heat medium flow switching devices 32 control the flow rate of the heat medium flowing into the utilization units 30. In this process, the heat medium flow switching devices 32 supply the utilization units 30 with the secondary-side heat medium transported from both of the intermediate heat exchangers 3*a* and 4*a*.

In the use-side heat exchangers 33, the secondary-side heat medium flowing into the utilization units 30 exchanges heat with the indoor air of the indoor space. Thereby, the heating operation by the utilization units 30 is performed. The heat medium subjected to the heat exchange in the use-side heat exchangers 33 flows into the intermediate heat exchangers 3*a* and 4*a* through the heat medium pipes and the heat medium flow switching devices 32. Then, in the intermediate heat exchangers 3*a* and 4*a*, the heat medium receives from the refrigerant an amount of heat equal to the amount of heat supplied to the indoor space through the utilization units 30, and is again transported to the heat medium transport devices 31*a* and 31*b*.

[Cooling Main Operation Mode]

Figure 2:
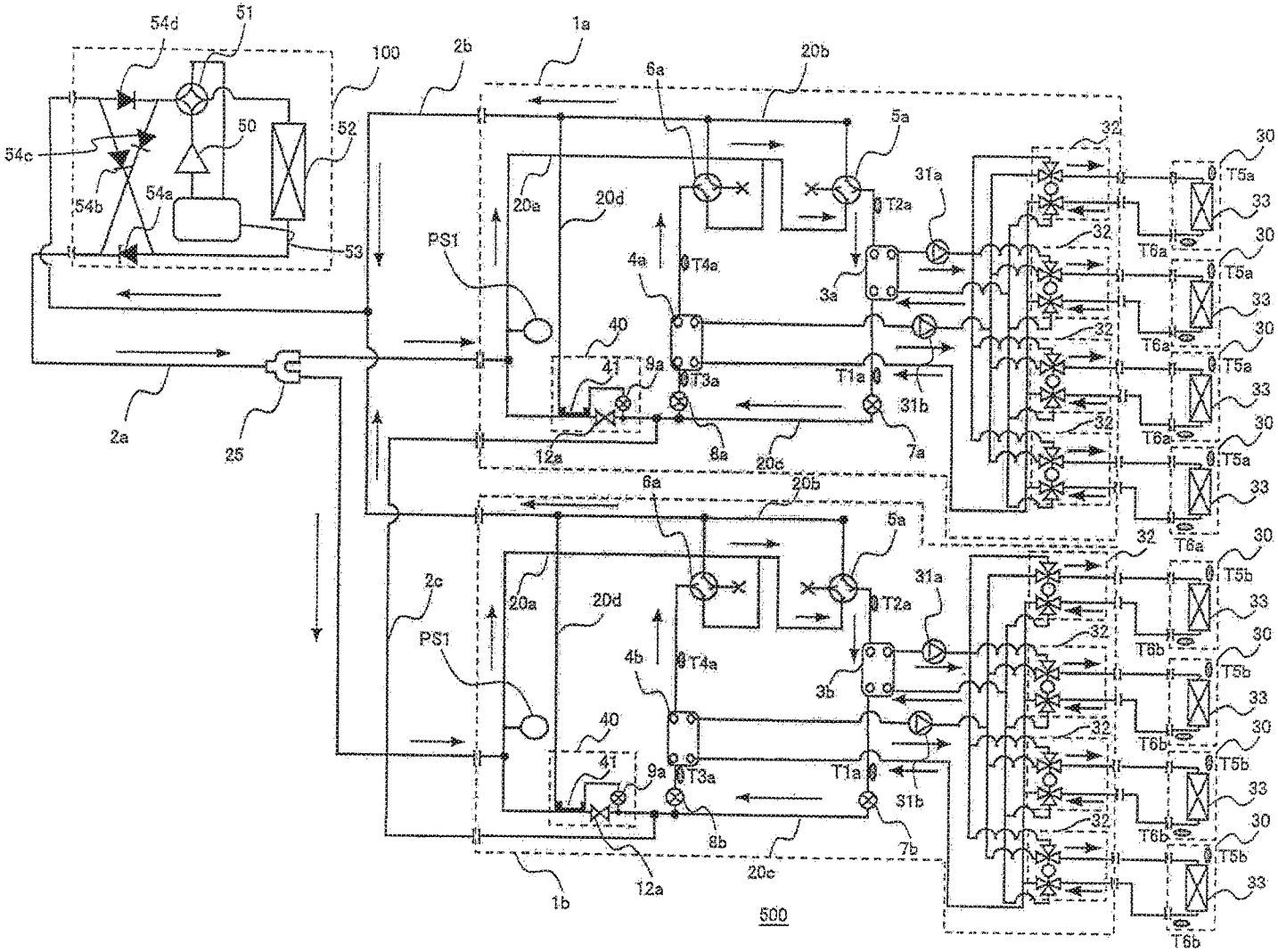
FIG. 2 is a diagram illustrating a flow of refrigerant in a cooling main operation mode in Embodiment 1.

A description will now be given of the flow of the refrigerant in the cooling main operation mode of the mixed operation mode. FIG. 2 is a diagram illustrating the flow of the refrigerant in the cooling main operation mode. Low-temperature, low-pressure refrigerant flows into the compressor 50, and is discharged as high-temperature, high-pressure gas refrigerant. The discharged high-temperature, high-pressure refrigerant passes through the refrigerant flow switching device 51 of the heat source unit 100, and flows into the heat source-side heat exchanger 52. In the heat source-side heat exchanger 52, the heat capacity of the refrigerant excluding the heat capacity required by any utilization unit 30 that performs the heating operation is rejected, and the refrigerant turns into two-phase gas-liquid refrigerant.

The two-phase gas-liquid refrigerant from the heat source unit 100 flows into the first distribution unit 1*a* through the high-pressure refrigerant pipe 2*a*. In the first distribution unit 1*a*, the first refrigerant flow switching device 5*a* has been switched to heating, and the second refrigerant flow switching device 6*a* has been switched to cooling. The refrigerant flowing into the first distribution unit 1*a* and passing through the first refrigerant flow switching device 5*a* flows into the intermediate heat exchanger 3*a*. The high-temperature, high-pressure, two-phase gas-liquid refrigerant flowing into the intermediate heat exchanger 3*a* provides an amount of heat to the secondary-side heat medium, such as water or antifreeze, similarly flowing into the intermediate heat exchanger 3*a*, and condenses into high-temperature, high-pressure liquid. The refrigerant having turned into the high-temperature, high-pressure liquid passes through the first expansion device 7*a* to be expanded into intermediate-pressure liquid refrigerant. In this process, the outlet refrigerant temperature of the intermediate heat exchanger 3*a* is detected by the temperature sensor T1*a*, and the first expansion device 7*a* is controlled such that the degree of subcooling equals a target value (10 degrees Celsius, for example).

Then, the refrigerant having turned into the intermediate-pressure liquid refrigerant passes through the second expansion device 8*a* to turn into low-temperature, low-pressure refrigerant, and flows into the intermediate heat exchanger 4*a*. The refrigerant flowing into the intermediate heat exchanger 4*a* receives an amount of heat from the secondary-side heat medium, such as water or antifreeze, similarly flowing into the intermediate heat exchanger 4*a*, and thereby evaporates into low-temperature, low-pressure gas refrigerant. In this process, the temperature of the refrigerant having passed through the intermediate heat exchanger 4*a* and subjected to the heat exchange is detected by the temperature sensor T4*a*, and the second expansion device 8*a*, through which the refrigerant passes, is controlled such that the degree of superheat of the second expansion device 8*a* equals a target value (2 degrees Celsius, for example). The low-temperature, low-pressure gas refrigerant passes through the second refrigerant flow switching device 6*a*, and thereafter is transported to the heat source unit 100 through the low-pressure refrigerant pipe 2*b* and returned to the compressor 50.

The flow of the secondary-side heat medium in the cooling main operation mode will now be described. As described above, the secondary-side heat medium reduced in temperature in the intermediate heat exchanger 4*a* is transported by the heat medium transport device 31*b* connected to the intermediate heat exchanger 4*a*. Further, the secondary-side heat medium increased in temperature in the intermediate heat exchanger 3*a* is transported by the heat medium transport device 31*a* connected to the intermediate heat exchanger 3*a*. The flow rate of the transported secondary-side heat medium flowing into each of the utilization units 30 is controlled by the heat medium flow switching device 32 connected to the utilization unit 30. In this process, if the utilization unit 30 connected to the heat medium flow switching device 32 performs the heating operation, the heat medium flow switching device 32 is switched to the direction in which the heat medium flow switching device 32 is connected to the intermediate heat exchanger 3*a* and the heat medium transport device 31*a*. If the utilization unit 30 connected to the heat medium flow switching device 32 performs the cooling operation, the heat medium flow switching device 32 is switched to the direction in which the heat medium flow switching device 32 is connected to the intermediate heat exchanger 4*a* and the heat medium transport device 31*b*.

That is, the secondary-side heat medium to be supplied to the utilization unit 30 is switched to hot water or cold water in accordance with the operation mode of the utilization unit 30. In the use-side heat exchanger 33, the secondary-side heat medium flowing into the utilization unit 30 exchanges heat with the indoor air of the indoor space. Thereby, the heating operation or the cooling operation by the utilization unit 30 is performed. The secondary-side heat medium subjected to the heat exchange in the use-side heat exchanger 33 flows into the heat medium flow switching device 32. If the utilization unit 30 connected to the heat medium flow switching device 32 is performing the heating operation, the heat medium flow switching device 32 is switched to the direction in which the heat medium flow switching device 32 is connected to the intermediate heat exchanger 3*a*. If the utilization unit 30 connected to the heat medium flow switching device 32 is performing the cooling operation, the heat medium flow switching device 32 is switched to the direction in which the heat medium flow switching device 32 is connected to the intermediate heat exchanger 4*a*. Thereby, the secondary-side heat medium used in the heating operation appropriately flows into the intermediate heat exchanger 3*a* in which the refrigerant provides heat for heating purpose, and the secondary-side heat medium used in the cooling operation appropriately flows into the intermediate heat exchanger 4*a* in which the refrigerant receives heat for cooling purpose. Then, the secondary-side heat medium again exchanges heat with the refrigerant in each of the intermediate heat exchangers 3*a* and 4*a*, and thereafter is transported to the heat medium transport devices 31*a* and 31*b*.

[Heating Main Operation Mode]

The flow of the refrigerant in the heating main operation mode will now be described. Low-temperature, low-pressure refrigerant flows into the compressor 50, and is discharged as high-temperature, high-pressure gas refrigerant. The discharged high-temperature, high-pressure gas refrigerant flows into the high-pressure refrigerant pipe 2*a* from the heat source unit 100. That is, in the heating main operation mode, the refrigerant flow switching device 51 is switched to transport the high-temperature, high-pressure gas refrigerant discharged from the compressor 50 to the outside of the heat source unit 100 without through the heat source-side heat exchanger 52. The gas refrigerant from the heat source unit 100 flows into the first distribution unit 1*a* through the high-pressure refrigerant pipe 2*a*.

In the first distribution unit 1*a*, the first refrigerant flow switching device 5*a* has been switched to heating, and the second refrigerant flow switching device 6*a* has been switched to cooling. The gas refrigerant flowing into the first distribution unit 1*a* and passing through the first refrigerant flow switching device 5*a* flows into the intermediate heat exchanger 3*a*. The high-temperature, high-pressure gas refrigerant flowing into the intermediate heat exchanger 3*a* provides an amount of heat to the secondary-side heat medium, such as water or antifreeze, similarly flowing into the intermediate heat exchanger 3*a*, and condenses into high-temperature, high-pressure liquid. The refrigerant having turned into the high-temperature, high-pressure liquid passes through the first expansion device 7*a* to be expanded into intermediate-pressure liquid refrigerant, and flows into the second expansion device 8*a*. The subsequent flow of the refrigerant and the flow of the secondary-side heat medium in the heating main operation mode are similar to those in the cooling main operation mode.

Herein, a case in which the operation mode of the first distribution unit 1*a* and the operation mode of the second distribution unit 1*b* are different from each other and are specific operation modes includes a case in which the refrigerant is transported from the first distribution unit 1*a* to the second distribution unit 1*b* via the intermediate-pressure refrigerant pipe 2*c* or a case opposite thereto (a case in which the refrigerant is transported from the second distribution unit 1*b* to the first distribution unit 1*a* via the intermediate-pressure refrigerant pipe 2*c*). For example, if the first distribution unit 1*a* is in the heating only operation mode and the second distribution unit 1*b* is in the cooling only operation mode, the high-temperature, high-pressure gas refrigerant from the heat source unit 100 only flows into the first distribution unit 1*a* from the high-pressure refrigerant pipe 2*a*. Thereafter, the refrigerant is turned into intermediate-pressure liquid refrigerant by the intermediate heat exchangers 3*a* and 4*a*, the first expansion device 7*a*, and the second expansion device 8*a* of the first distribution unit 1*a*, and flows into the second distribution unit 1*b* through the intermediate-pressure refrigerant pipe 2*c*. The refrigerant then flows into the low-pressure refrigerant pipe 2*b* through a first expansion device 7*b*, a second expansion device 8*b*, and intermediate heat exchangers 3*b* and 4*b* of the second distribution unit 1*b*, and is transported to the heat source unit 100 and returned to the compressor 50. Meanwhile, if the operation mode of the first distribution unit 1*a* and the operation mode of the second distribution unit 1*b* are the same, the refrigerant flowing into the high-pressure refrigerant pipe 2*a* from the heat source unit 100 is distributed into the first distribution unit 1*a* and the second distribution unit 1*b* by the distribution pipe 25.

Figure 3:
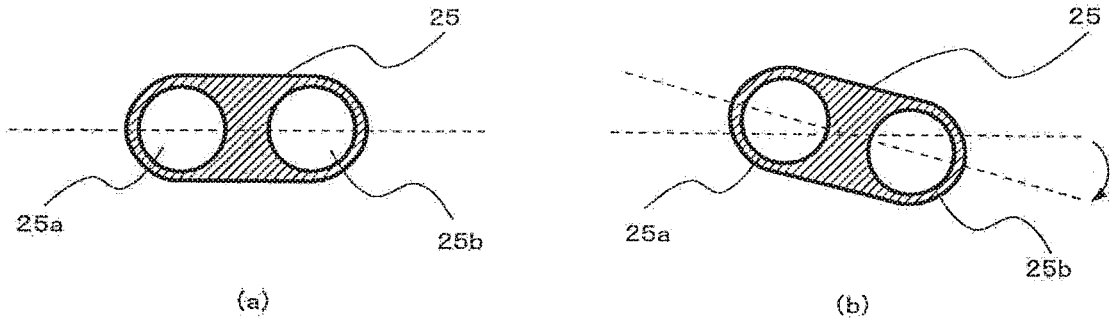
FIG. 3 includes longitudinal sectional views of a distribution pipe of Embodiment 1, with (a) illustrating a state in which the distribution pipe is horizontally installed, and (b) illustrating a state in which the distribution pipe is installed with an inclination.

FIG. 3 includes longitudinal sectional views of the distribution pipe 25, with (a) illustrating a state in which the distribution pipe 25 is horizontally installed, and (b) illustrating a state in which the distribution pipe 25 is installed with an inclination. As illustrated in FIG. 3, the distribution pipe 25 has a branch passage 25*a* connected to the first distribution unit 1*a* and a branch passage 25*b* connected to the second distribution unit 1*b*. Herein, the state in which the branch passage 25*a* and the branch passage 25*b* are aligned horizontally, that is, in parallel to a direction perpendicular to the gravity direction, as illustrated in (a) of FIG. 3, will be referred to as the state in which the distribution pipe 25 is horizontally installed. In the state in which the distribution pipe 25 is installed with an inclination with respect to the horizontal, as illustrated in (b) of FIG. 3, the branch passage 25*a* and the branch passage 25*b* are positioned at different heights in the gravity direction.

Herein, if the first distribution unit 1*a* and the second distribution unit 1*b* are both in the cooling main operation mode, or if one of the first distribution unit 1*a* and the second distribution unit 1*b* is in the cooling main operation mode, the other one of the first distribution unit 1*a* and the second distribution unit 1*b* is in the heating main operation mode, and an overall cooling load is large, the two-phase gas-liquid refrigerant flows into the high-pressure refrigerant pipe 2*a* from the heat source unit 100, and is distributed into the first distribution unit 1*a* and the second distribution unit 1*b* by the distribution pipe 25. In this case, the inclination of the distribution pipe 25, as illustrated in (b) of FIG. 3, results in unevenness in quality (unevenness between gas and liquid) between the refrigerant distributed into the first distribution unit 1*a* and the refrigerant distributed into the second distribution unit 1*b*. A factor of the unevenness in quality of the refrigerant is gravity. Gravity acts to facilitate the flow of the liquid refrigerant into the lower-positioned branch passage (the branch passage 25*b* in the case of (b) in FIG. 3). Further, the second factor is gas-liquid shear force. The liquid refrigerant present on a pipe wall of the high-pressure refrigerant pipe 2*a* in the form of a liquid film is drawn and moved by the shear force of the gas refrigerant flowing through the center of the pipe. Further, the third factor is a liquid droplet generation amount. Liquid droplets generated in the high-pressure refrigerant pipe 2*a* are directly carried into the gas refrigerant and moved. Due to these factors, high-quality refrigerant (with a large amount of gas) is distributed into the branch passage 25*a* on the upper side of the horizontal illustrated in (b) of FIG. 3, and low-quality refrigerant (with a large amount of liquid) is distributed into the branch passage 25*b* on the lower side of the horizontal.

Figure 4:
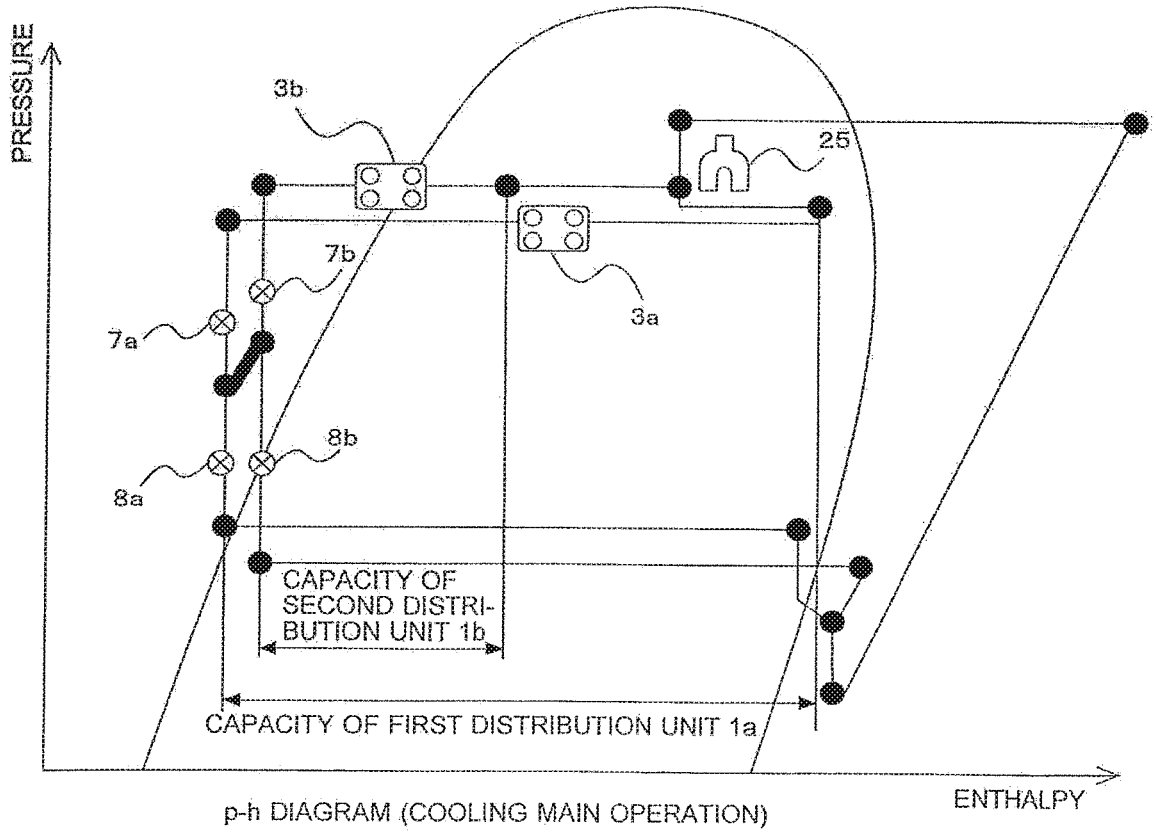
FIG. 4 is a p-h diagram of the refrigeration cycle apparatus with the distribution pipe of Embodiment 1 inclined as illustrated in (b) of FIG. 3.

FIG. 4 is a p-h diagram of the refrigeration cycle apparatus 500 with the distribution pipe 25 inclined as illustrated in (b) of FIG. 3. With reference to FIG. 4, a description will be given of a change in the state of the refrigerant in the refrigeration cycle apparatus 500 when the cooling main operation mode is executed in the inclined state of the distribution pipe 25. In the heat source-side heat exchanger 52, a part of the gas refrigerant compressed into high-temperature, high-pressure refrigerant by the compressor 50 first transfers the heat thereof to the air, and flows into the high-pressure refrigerant pipe 2*a* as two-phase gas-liquid refrigerant. Thereafter, the refrigerant is distributed into the first distribution unit 1*a* and the second distribution unit 1*b* by the distribution pipe 25.

In this process, the high-quality refrigerant and the low-quality refrigerant flow into the first distribution unit 1*a* and the second distribution unit 1*b*, respectively, due to the inclination of the distribution pipe 25. The refrigerants then flow into the intermediate heat exchangers 3*a* and 3*b*, respectively, each serving as the condenser in the cooling main operation mode, heat the secondary-side heat medium to condense, and are subcooled beyond the saturated liquid line. In this process, the degree of subcooling of the intermediate heat exchanger 3*a* and the degree of subcooling of the intermediate heat exchanger 3*b* are controlled with the first expansion device 7*a* and the first expansion device 7*b*, respectively, as described above. The refrigerants are then expanded by the second expansion device 8*a* and the second expansion device 8*b*, respectively, and turn into low-temperature, low-pressure two-phase refrigerants.

Herein, in the second distribution unit 1*b*, into which the low-quality refrigerant flows, insufficient heating capacity due to a small difference in enthalpy is conceivable. Therefore, if the first expansion device 7*b* is controlled in the second distribution unit 1*b* with the target value set to a degree of subcooling similar to that in the first distribution unit 1*a*, into which the high-quality refrigerant flows, unevenness is caused between the capacity of the first distribution unit 1*a* and the capacity of the second distribution unit 1*b*, as illustrated in FIG. 4.

Figure 5:
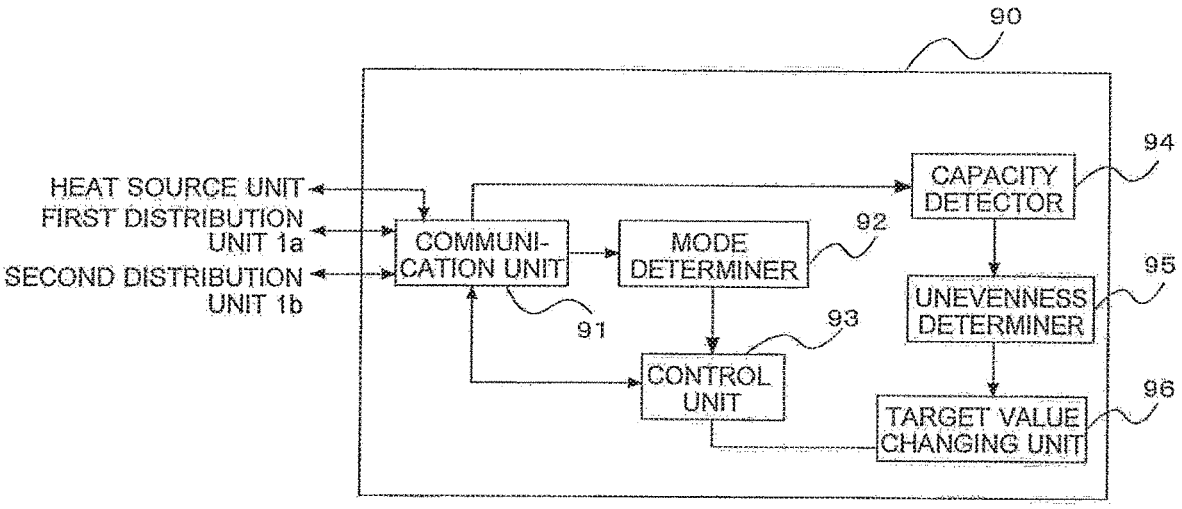
FIG. 5 is a functional block diagram of a controller of Embodiment 1.

In Embodiment 1, therefore, the controller 90 of the heat source unit 100 determines whether or not unevenness is caused between the capacity of the first distribution unit 1*a* and the capacity of the second distribution unit 1*b*, and performs a correcting process if the unevenness is caused. FIG. 5 is a functional block diagram of the controller 90 of Embodiment 1. The controller 90, which is formed of a device such as a microcomputer or a digital signal processor (DSP), controls the entire refrigeration cycle apparatus 500. As illustrated in FIG. 5, the controller 90 includes a communication unit 91 that transmits and receives a variety of information to and from the first distribution unit 1*a* and the second distribution unit 1*b*, a mode determiner 92 that determines the operation mode of the heat source unit 100, a control unit 93 that controls the respective units of the refrigeration cycle apparatus 500, a capacity detector 94 that detects the capacity of the first distribution unit 1*a* and the capacity of the second distribution unit 1*b*, an unevenness determiner 95 that determines whether or not the capacity of the first distribution unit 1*a* and the capacity of the second distribution unit 1*b* are even, and a target value changing unit 96 that changes a control target value if the unevenness in capacity is determined. The above-described units are implemented through the execution of a program by a CPU forming the controller 90 as functional units implemented by software, or are implemented by an electronic circuit, such as a DSP, an application specific IC (ASIC), or a programmable logic device (PLD). The controller 90 is not necessarily provided to the heat source unit 100, and may be configured to be provided to a device such as one of the first distribution unit 1*a* and the second distribution unit 1*b* or a remote monitoring apparatus.

The communication unit 91 communicates with the first distribution unit 1*a* and the second distribution unit 1*b*, and receives a variety of information including temperature information detected by the temperature sensors T1*a* to T6*a* and pressure information detected by the high pressure-side pressure sensor PS1. The communication unit 91 further transmits to the first distribution unit 1*a* and the second distribution unit 1*b* control signals for controlling the units of the first distribution unit 1*a* and the units of the second distribution unit 1*b*. The mode determiner 92 determines which one of the heating only operation mode, the cooling only operation mode, the cooling main operation mode, and the heating main operation mode is the operation mode of each of the first distribution unit 1*a* and the second distribution unit 1*b*. The mode determiner 92 determines the operation mode of each of the distribution units based on the information of the operation mode of the utilization units 30 connected to the first distribution unit 1*a* and the second distribution unit 1*b*, which is received via the communication unit 91.

The control unit 93 controls the units of the heat source unit 100, the units of the first distribution unit 1*a*, and the units of the second distribution unit 1*b* based on the variety of information including the temperature information detected by the temperature sensors T1*a* to T6*a* and the pressure information detected by the high pressure-side pressure sensor PS1, which is received via the communication unit 91. Specifically, the control unit 93 controls, for example, the rotation speed of the compressor 50, the switching of the refrigerant flow switching devices 51, 5*a*, and 6*a* and the heat medium flow switching devices 32, the respective opening degrees of the expansion devices 7*a*, 7*b*, 8*a*, 8*b*, and 9*a*, the opening and closing of the opening and closing valves 12*a*, and the flow rates according to the heat medium transport devices 31*a* and 31*b*. The control unit 93 further controls the respective opening degrees of the first expansion devices 7*a* and 7*b* in accordance with the respective target values changed by the target value changing unit 96.

The capacity detector 94 detects the heating capacity of each of the first distribution unit 1*a* and the second distribution unit 1*b*. Specifically, the capacity detector 94 receives, via the communication unit 91, a suction air temperature Tair detected by the temperature sensor T5*a* of each utilization unit 30 performing the heating operation among the utilization units 30 connected to the first distribution unit 1*a* and a heat medium temperature Twout at the outlet of the utilization unit 30 detected by the temperature sensor T6*a*. The capacity detector 94 then calculates a difference ΔTaw between the suction air temperature Tair and the heat medium temperature Twout at the outlet of the each utilization unit 30 performing the heating operation. Then, the capacity detector 94 transmits a mean value ΔTaw1 of the calculated temperature difference ΔTaw to the unevenness determiner 95 as an indicator representing the capacity (heating capacity) of the first distribution unit 1*a*. The capacity detector 94 similarly calculates, via the communication unit 91, ΔTaw2, which is an indicator representing the capacity of the second distribution unit 1*b*, from the suction air temperature Tair detected by a temperature sensor T5*b* of each utilization unit 30 performing the heating operation among the utilization units 30 connected to the second distribution unit 1*b* and the heat medium temperature Twout at the outlet of the use-side heat exchanger 33 detected by a temperature sensor T6*b*, and transmits ΔTaw2 to the unevenness determiner 95. Herein, ΔTaw1 and ΔTaw2 do not directly represent the capacity (heating capacity) of the first distribution unit 1*a* and the capacity (heating capacity) of the second distribution unit 1*b*, respectively, but are indicators representing the respective capacities. For the convenience of explanation, however, ΔTaw1 and ΔTaw2 will be referred to as the "capacity ΔTaw1" and the "capacity ΔTaw2," respectively.

The unevenness determiner 95 determines whether or not the capacity of the first distribution unit 1*a* and the capacity of the second distribution unit 1*b* are even based on the capacity ΔTaw1 of the first distribution unit 1*a* and the capacity ΔTaw2 of the second distribution unit 1*b* received from the capacity detector 94. Specifically, if the absolute value of the difference between ΔTaw1 and ΔTaw2 is greater than a threshold α, the unevenness determiner 95 determines unevenness in capacity. Herein, the threshold α is set to 2 to 3 (degrees Celsius), for example. Then, if the capacity of the first distribution unit 1*a* and the capacity of the second distribution unit 1*b* are uneven, the unevenness determiner 95 notifies the target value changing unit 96 of the unevenness.

If notified by the unevenness determiner 95 that the capacity of the first distribution unit 1*a* and the capacity of the second distribution unit 1*b* are uneven, the target value changing unit 96 changes the target value of the degree of subcooling at the outlet of the intermediate heat exchanger 3*a* or 3*b*. Specifically, the target value changing unit 96 compares the capacity ΔTaw1 of the first distribution unit 1*a* with the capacity ΔTaw2 of the second distribution unit 1*b*. If the capacity ΔTaw1 of the first distribution unit 1*a* is higher than the capacity ΔTaw2 of the second distribution unit 1*b*, the target value changing unit 96 increases the target value of the degree of subcooling at the outlet of the intermediate heat exchanger 3*a* of the first distribution unit 1*a*. Meanwhile, if the capacity ΔTaw2 of the second distribution unit 1*b* is higher than the capacity ΔTaw1 of the first distribution unit 1*a*, the target value changing unit 96 increases the target value of the degree of subcooling at the outlet of the intermediate heat exchanger 3*b* of the second distribution unit 1*b*. The target value changing unit 96 then transmits the changed target value to the control unit 93. Herein, the target value changing unit 96 may increase the target value of the degree of subcooling in the distribution unit with high capacity by a preset value (1 degree Celsius, for example) or by a value according to the difference in capacity between the first distribution unit 1*a* and the second distribution unit 1*b*. For example, the target value changing unit 96 may increase the target value by a value proportional to the difference in capacity between the first distribution unit 1*a* and the second distribution unit 1*b*.

The control unit 93 controls the opening degree of the first expansion device 7*a* or the first expansion device 7*b* in accordance with the target value of the degree of subcooling received from the target value changing unit 96. With the thus-increased target value of the degree of subcooling in the distribution unit with high capacity, the opening degree of the first expansion device 7*a* or the first expansion device 7*b* is reduced. This enables a reduction in the refrigerant flow rate in the distribution unit with high capacity and thus the correction of the unevenness in capacity.

Figure 6:
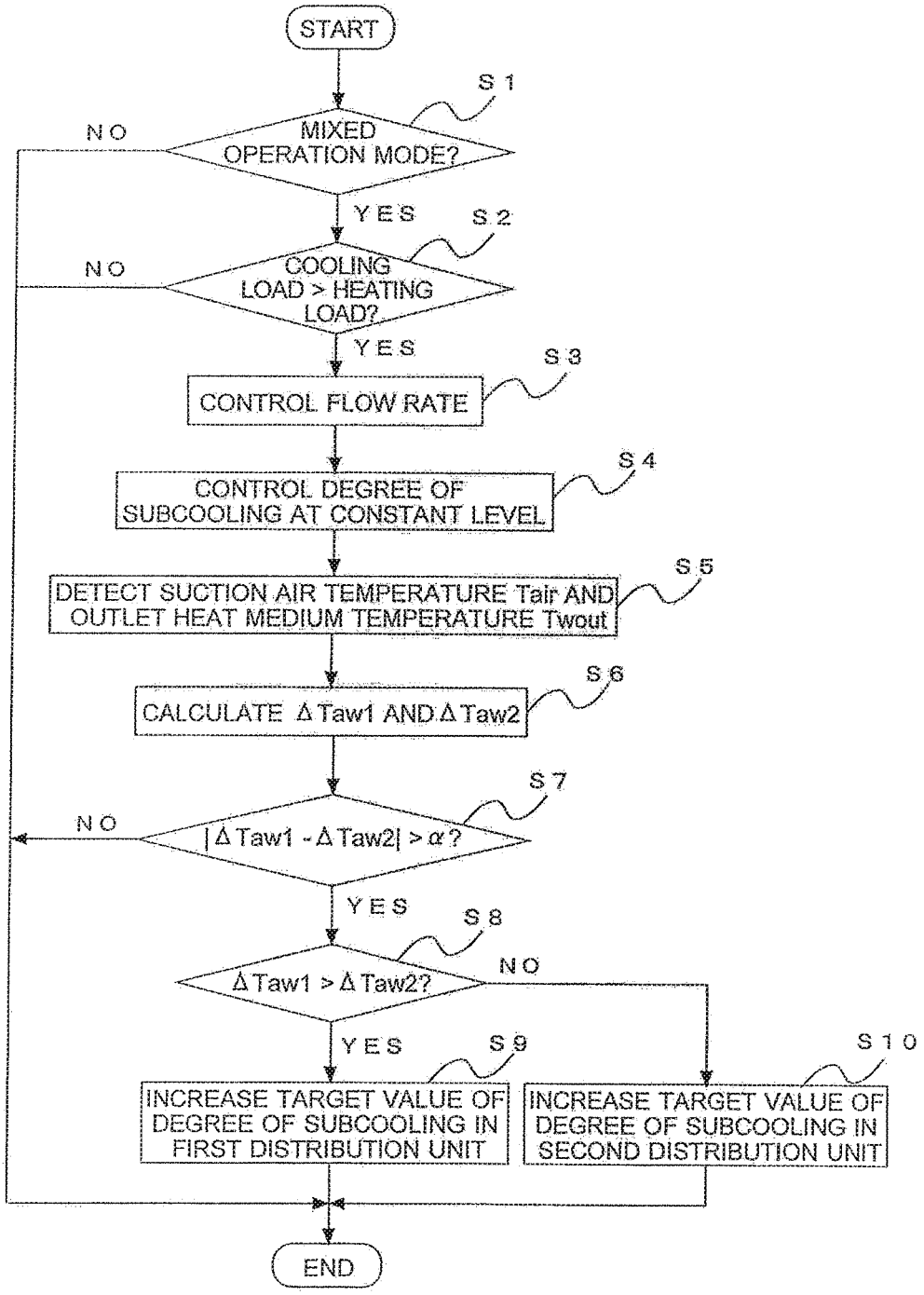
FIG. 6 is a flowchart illustrating a flow of an unevenness correcting process of Embodiment 1.

FIG. 6 is a flowchart illustrating a flow of the unevenness correcting process of Embodiment 1. The present process is executed with the start of the operation of the heat source unit 100. The process may further be executed at each change of the operation mode during the operation of the heat source unit 100. In the present process, the mode determiner 92 first determines whether or not both of the first distribution unit 1*a* and the second distribution unit 1*b* are in the mixed operation mode (S1). Then, if both of the first distribution unit 1*a* and the second distribution unit 1*b* are not in the mixed operation mode (S1: NO), the present process is completed. If both of the first distribution unit 1*a* and the second distribution unit 1*b* are not in the mixed operation mode, the two-phase gas-liquid refrigerant is not distributed by the distribution pipe 25. Even if the distribution pipe 25 is inclined, therefore, the unevenness of the refrigerant to be distributed is unlikely to be caused, and thus there is no need to perform the correcting process.

Meanwhile, if both of the first distribution unit 1*a* and the second distribution unit 1*b* are in the mixed operation mode (S1: YES), it is determined whether or not the cooling load is greater than the heating load in the entirety of the first distribution unit 1*a* and the second distribution unit 1*b* (S2). Then, if the cooling load is equal to or less than the heating load in the entirety (S2: NO), the present process is completed. If both of the first distribution unit 1*a* and the second distribution unit 1*b* are in the mixed operation mode, and if the cooling load is equal to or less than the heating load, high-temperature, high-pressure gas refrigerant is supplied from the heat source unit 100 and distributed by the distribution pipe 25. Even if the distribution pipe 25 is inclined, therefore, the unevenness of the refrigerant to be distributed is unlikely to be caused, and thus there is no need to perform the correcting process.

Meanwhile, if the cooling load is greater than the heating load in the entirety (S2: YES), the control unit 93 controls the flow rate of the heat medium with the heat medium transport devices 31*a* and 31*b* and the heat medium flow switching devices 32 of the first distribution unit 1*a* and the second distribution unit 1*b* to maintain a constant temperature difference of the heat medium between the inlet and the outlet of each of the utilization units 30 (S3). Then, the control unit 93 controls the opening degree of each of the first expansion device 7*a* and the first expansion device 7*b* such that the degree of subcooling at the outlet of each of the intermediate heat exchangers 3*a* and 3*b* equals a predetermined target value (10 degrees Celsius, for example) (S4). Then, the suction air temperature Tair (degrees Celsius) and the heat medium temperature Twout (degrees Celsius) at the outlet of each utilization unit 30 performing the heating operation among the utilization units 30 are detected by the temperature sensors T5*a* and T6*a* or T5*b* and T6*b* (S5).

Then, based on the suction air temperature Tair and the heat medium temperature Twout, the capacity detector 94 calculates the capacity ΔTaw1 of the first distribution unit 1*a* and the capacity ΔTaw2 of the second distribution unit 1*b* (S6). Then, the unevenness determiner 95 determines whether or not the absolute value of the difference between ΔTaw1 and ΔTaw2 is greater than the threshold α (S7). Herein, whether or not the unevenness in capacity is caused is determined based on whether or not the difference in capacity between the first distribution unit 1*a* and the second distribution unit 1*b* is greater than the predetermined threshold. Then, if the absolute value of the difference between ΔTaw1 and ΔTaw2 is equal to or less than the threshold α (S7: NO), it is determined that there is no unevenness between the capacity of the first distribution unit 1*a* and the capacity of the second distribution unit 1*b*, and the present process is completed. In this case, it is considered that the distribution pipe 25 is installed substantially horizontally, and that the refrigerant is evenly distributed into the first distribution unit 1*a* and the second distribution unit 1*b*.

Meanwhile, if the absolute value of the difference between ΔTaw1 and ΔTaw2 is greater than the threshold α (S7: YES), it is determined that the capacity of the first distribution unit 1*a* and the capacity of the second distribution unit 1*b* are uneven. In this case, it is considered that the distribution pipe 25 is installed with an inclination with respect to the horizontal, and that the refrigerant is not distributed into the first distribution unit 1*a* and the second distribution unit 1*b* with an even proportion of gas and liquid. Then, the target value changing unit 96 determines whether or not ΔTaw1 is greater than ΔTaw2 (S8).

If ΔTaw1 is greater than ΔTaw2 (S8: YES), the target value of the degree of subcooling at the outlet of the intermediate heat exchanger 3*a* in the first distribution unit 1*a* is increased (S9). If ΔTaw1 is greater than ΔTaw2, it is considered that the capacity of the first distribution unit 1*a* is higher than the capacity of the second distribution unit 1*b*. Therefore, the target value of the degree of subcooling in the first distribution unit 1*a* is increased to correct the unevenness in capacity. Meanwhile, if ΔTaw1 is equal to or less than ΔTaw2 (S8: NO), the target value of the degree of subcooling at the outlet of the intermediate heat exchanger 3*b* in the second distribution unit 1*b* is increased (S10). If ΔTaw1 is equal to or less than ΔTaw2 (that is, if ΔTaw2 is greater than ΔTaw1), it is considered that the capacity of the second distribution unit 1*b* is higher than the capacity of the first distribution unit 1*a*. Therefore, the target value of the degree of subcooling in the second distribution unit 1*b* is increased to correct the unevenness in capacity.

As described above, in Embodiment 1, if unevenness is caused between the capacity of the first distribution unit 1*a* and the capacity of the second distribution unit 1*b*, the target value of the degree of subcooling is changed to enable the correction of the unevenness. That is, if the refrigerant passing through the distribution pipe 25 is unevenly distributed into the first distribution unit 1*a* and the second distribution unit 1*b*, the degree of subcooling at the outlet of one of the first distribution unit 1*a* and the second distribution unit 1*b* of which the distributed refrigerant is of high quality (that is, the distribution unit with high capacity) is increased to enable the correction of the unevenness in capacity. Therefore, even if the distribution pipe 25 is installed with an inclination with respect to the horizontal and the refrigerant is distributed with an uneven proportion of gas and liquid, it is possible to correct the unevenness without re-installing the distribution pipe 25. In the correction according to the correcting process of Embodiment 1, the inclination of the distribution pipe 25 is desirably 40 degrees or less, but is not limited thereto.

Further, with the capacity of each of the first distribution unit 1*a* and the second distribution unit 1*b* calculated based on the difference ΔTaw between the suction air temperature Tair and the heat medium temperature Twout at the outlet of each utilization unit 30 performing the heating operation, it is possible to determine the evenness or unevenness of the capacity without checking the installed state (inclination) of the distribution pipe 25.

Further, with the target value of the degree of subcooling in the distribution unit with high capacity increased by the preset value by the target value changing unit 96, it is possible to simplify the process. Meanwhile, with the target value of the degree of subcooling in the distribution unit with high capacity increased by the target value changing unit 96 by the value according to the difference in capacity between the first distribution unit 1*a* and the second distribution unit 1*b*, it is possible to set an optimal degree of subcooling according to the difference in capacity.

Further, the correcting process is performed only if both of the first distribution unit 1*a* and the second distribution unit 1*b* are in the mixed operation mode and the cooling load is greater than the heating load in the entirety of the first distribution unit 1*a* and the second distribution unit 1*b*. It is thereby possible to prevent an unnecessary correcting process when the unevenness of the refrigerant to be distributed is unlikely to be caused even if the distribution pipe 25 is inclined, that is, when the refrigerant not in the two-phase gas-liquid state passes through the distribution pipe 25.

Embodiment 2

Subsequently, Embodiment 2 of the present invention will be described. Embodiment 2 is different from Embodiment 1 in the method of detecting the capacity of each of the first distribution unit 1*a* and the second distribution unit 1*b* performed by the capacity detector 94. Embodiment 2 is similar to Embodiment 1 in the other configurations of the refrigeration cycle apparatus 500.

Figure 7:
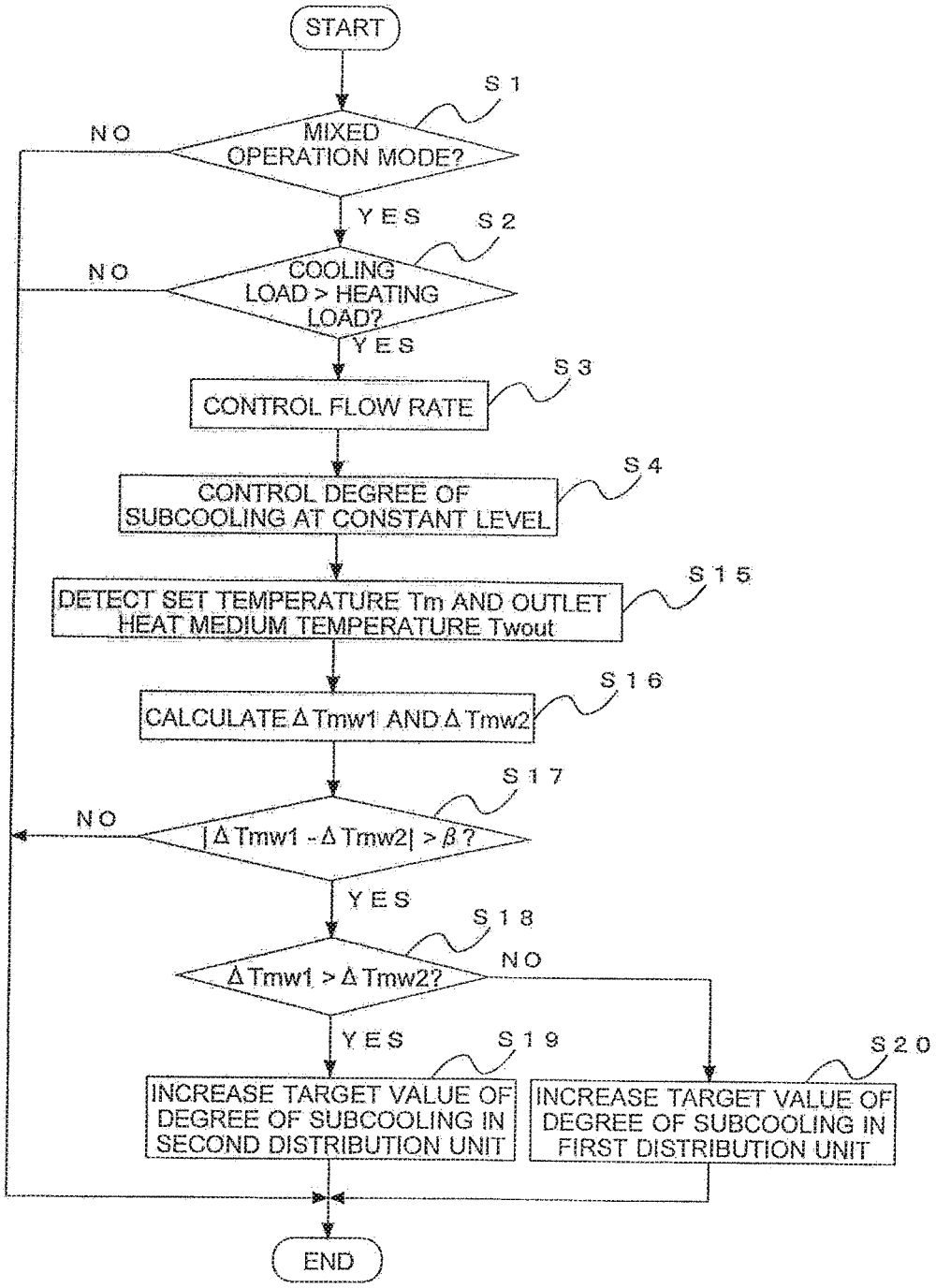
FIG. 7 is a flowchart illustrating a flow of an unevenness correcting process of Embodiment 2.

FIG. 7 is a flowchart illustrating a flow of an unevenness correcting process of Embodiment 2. In the present process, steps similar to those of Embodiment 1 illustrated in FIG. 6 are assigned with the same signs as those of Embodiment 1. Similarly as in Embodiment 1, the mode determiner 92 first determines whether or not both of the first distribution unit 1*a* and the second distribution unit 1*b* are in the mixed operation mode (S1). Then, if both of the first distribution unit 1*a* and the second distribution unit 1*b* are not in the mixed operation mode (S1: NO), the present process is completed. Meanwhile, if both of the first distribution unit 1*a* and the second distribution unit 1*b* are in the mixed operation mode (S1: YES), it is determined whether or not the cooling load is greater than the heating load in the entirety of the first distribution unit 1*a* and the second distribution unit 1*b* (S2). Then, if the cooling load is equal to or less than the heating load in the entirety (S2: NO), the present process is completed.

If the cooling load is greater than the heating load in the entirety (S2: YES), the control unit 93 controls the flow rate of the heat medium with the heat medium transport devices 31*a* and 31*b* and the heat medium flow switching devices 32 of the first distribution unit 1*a* and the second distribution unit 1*b* to maintain a constant temperature difference of the heat medium between the inlet and the outlet of each of the utilization units 30 (S3). The control unit 93 then controls the opening degree of each of the first expansion device 7*a* and the first expansion device 7*b* such that the degree of subcooling at the outlet of each of the intermediate heat exchangers 3*a* and 3*b* equals a predetermined target value (10 degrees Celsius, for example) (S4). Then, a set temperature Tm (degrees Celsius) of each utilization unit 30 performing the heating operation among the utilization units 30 is detected from the utilization unit 30, and the heat medium temperature Twout (degrees Celsius) at the outlet of the utilization unit 30 is detected by the temperature sensor T6*a* or T6*b* (S15).

Then, based on the set temperature Tm and the heat medium temperature Twout, the capacity detector 94 calculates capacity ΔTmw1 of the first distribution unit 1*a* and capacity ΔTmw2 of the second distribution unit 1*b* (S16). Herein, a difference ΔTmw between the set temperature Tm of a room and the heat medium temperature Twout at the outlet of each utilization unit 30 performing the heating operation is calculated, and a mean value ΔTmw1 of the calculated temperature difference ΔTmw is determined as an indicator representing the capacity (heating capacity) of the first distribution unit 1*a*. An indicator ΔTmw2 representing the capacity of the second distribution unit 1*b* is similarly obtained. Herein, similarly as in Embodiment 1, ΔTmw1 and ΔTmw2 do not directly represent the capacity (heating capacity) of the first distribution unit 1*a* and the capacity (heating capacity) of the second distribution unit 1*b*, respectively, but are indicators representing the respective capacities. For the convenience of explanation, however, ΔTmw1 and ΔTmw2 will be referred to as the "capacity ΔTmw1" and the "capacity ΔTmw2," respectively.

Then, the unevenness determiner 95 determines whether or not the absolute value of the difference between ΔTmw1 and ΔTmw2 is greater than a threshold β (S17). The threshold β is set to 2 to 3 (degrees Celsius), for example. Then, if the absolute value of the difference between ΔTmw1 and ΔTmw2 is equal to or less than the threshold β (S17: NO), it is determined that there is no unevenness between the capacity of the first distribution unit 1*a* and the capacity of the second distribution unit 1*b*, and the present process is completed.

Meanwhile, if the absolute value of the difference between ΔTmw1 and ΔTmw2 is greater than the threshold β (S17: YES), it is determined that the capacity of the first distribution unit 1*a* and the capacity of the second distribution unit 1*b* are uneven. Then, the target value changing unit 96 determines whether or not ΔTmw1 is greater than ΔTmw2 (S18). If ΔTmw1 is greater than ΔTmw2 (S18: YES), the target value of the degree of subcooling at the outlet of the intermediate heat exchanger 3*b* in the second distribution unit 1*b* is increased (S19). If ΔTmw1 is greater than ΔTmw2, it is considered that the capacity of the second distribution unit 1*b* is higher than the capacity of the first distribution unit 1*a*. Therefore, the target value of the degree of subcooling in the second distribution unit 1*b* is increased to reduce the refrigerant flow rate in the second distribution unit 1*b* and correct the unevenness in capacity. Meanwhile, if ΔTmw1 is equal to or less than ΔTmw2 (S18: NO), the target value of the degree of subcooling at the outlet of the intermediate heat exchanger 3*a* in the first distribution unit 1*a* is increased (S20). If ΔTmw1 is equal to or less than ΔTmw2 (that is, if ΔTmw2 is greater than ΔTmw1), it is considered that the capacity of the first distribution unit 1*a* is higher than the capacity of the second distribution unit 1*b*. Therefore, the target value of the degree of subcooling in the first distribution unit 1*a* is increased to reduce the refrigerant flow rate in the first distribution unit 1*a* and correct the unevenness in capacity.

As described above, effects similar to those of Embodiment 1 are attainable when the difference between the set temperature Tm of the utilization unit 30 and the heat medium temperature Twout at the outlet of the utilization unit 30 is determined as the capacity of each of the first distribution unit 1*a* and the second distribution unit 1*b*. Further, with the capacity of each of the first distribution unit 1*a* and the second distribution unit 1*b* obtained as in Embodiment 2, it is possible to correct the unevenness in capacity between the first distribution unit 1*a* and the second distribution unit 1*b* due to the inclination of the distribution pipe 25, even if it is difficult to detect the suction air temperature Tair in the room.

The foregoing description has been given of Embodiments 1 and 2 of the present invention based on the drawings. However, specific configurations of the present invention are not limited thereto, and Embodiments 1 and 2 may be modified within a scope not deviating from the gist of the invention. For example, Embodiments 1 and 2 described above are configured such that the first distribution unit 1*a* and the second distribution unit 1*b* having the same configuration are connected in parallel to the heat source unit 100, but the configuration is not limited thereto. For example, a configuration may be adopted, in which the first distribution unit 1*a* or the second distribution unit 1*b* is replaced by a direct expansion-type distribution unit that directly supplies the refrigerant to the utilization units 30.

Further, Embodiments 1 and 2 described above are configured such that two distribution units (the first distribution unit 1*a* and the second distribution unit 1*b*) are connected in parallel to the heat source unit 100, but may be configured such that three or more distribution units are connected in parallel to the heat source unit 100. In this case, the high-pressure refrigerant pipe 2*a* is provided with a distribution pipe having three or more horizontally aligned branch passages to distribute the refrigerant from the heat source unit 100. Similarly as in Embodiments 1 and 2 described above, it is possible in such a configuration to detect the capacity of each of the distribution units and determine whether or not the unevenness according to the difference in capacity is caused. Further, if the unevenness is caused, the control target value (the target value of the degree of subcooling) required to be changed in at least one of the plurality of distribution units may be changed to correct the unevenness.

Further, in Embodiments 1 and 2 described above, the mean value of the temperature difference between the suction air temperature Tair and the heat medium temperature Twout at the outlet or the mean value of the temperature difference between the set temperature Tm of the utilization unit 30 and the heat medium temperature Twout at the outlet is calculated as the capacity of each of the first distribution unit 1*a* and the second distribution unit 1*b*. However, the configuration is not limited thereto. For example, a flow rate sensor may be provided to the heat medium transport device 31*a* in each of the first distribution unit 1*a* and the second distribution unit 1*b*, and the flow rate of the heat medium detected by the flow rate sensor in a state in which the temperature difference of the heat medium between the inlet and the outlet of each of the utilization units 30 is controlled to be constant may be determined as the capacity of each of the first distribution unit 1*a* and the second distribution unit 1*b*. In this case, the control target value may be changed with a determination that the distribution unit having a high flow rate has high capacity. Further, if the heat medium pipes of the first distribution unit 1*a* and the heat medium pipes of the second distribution unit 1*b* have the same length, the rotation speed or the voltage value of the heat medium transport device 31*a* in each of the first distribution unit 1*a* and the second distribution unit 1*b* may be detected and determined as the capacity of each of the first distribution unit 1*a* and the second distribution unit 1*b*.

Further, the configuration may be modified to provide a reporting unit to the heat source unit 100 to, if the unevenness determiner 95 determines the unevenness between the capacity of the first distribution unit 1*a* and the capacity of the second distribution unit 1*b*, report the unevenness to a user such as an administrator, in addition to the correcting process by the target value changing unit 96. Further, the present invention is not limited to the multi-air-conditioning apparatus for a building, and may be applied to a large refrigeration cycle apparatus, such as a refrigerating machine or a heat pump chiller for cooling a refrigeration warehouse.

The invention claimed is:

1. A refrigeration cycle apparatus comprising:

a heat source unit including a compressor configured to supply refrigerant;

a first distributer and a second distributer respectively connected to the heat source unit, the first distributer and the second distributer individually including a heat exchanger configured to serve as a condenser;

a distribution pipe extending between the heat source unit and each of the first distributer and the second distributer, the distribution pipe including a first branch passage connected to the first distribution unit and a second branch passage connected to the second distribution unit, the distribution pipe including an inclined configuration where the distribution pipe inclines with respect to a horizontal state in which the first branch passage and the second branch passage are aligned in parallel to a direction perpendicular to a gravity direction;

a plurality of utilization units each including a use-side heat exchanger respectively connected to the first distributer and the second distributer; and a controller configured to control the first distributer and the second distributer, wherein the first distributer and the second distributer individually include an expansion valve, and the controller is configured to control an opening degree of each expansion valve of the first distributer and the second distributer and to provide a predetermined degree of subcooling at the outlet of each of the heat exchangers included in the first distributer and the second distributer, and wherein each of the plurality of utilization units includes two temperature sensors configured to detect a suction air temperature of air to be suctioned into each of the utilization units and a heat medium temperature at an outlet of each of the utilization units, respectively, and wherein the controller is configured to calculate a capacity of the first distributer and a capacity of the second distributer from a difference between the suction air temperature and the heat medium temperature of each utilization unit performing a heating operation among the plurality of utilization units or from a difference between a set temperature and the heat medium temperature of each utilization unit performing a heating operation among the plurality of utilization units, compare an absolute value of a difference between the capacity of the first distributer and the capacity of the second distributer with a threshold value, determine that the refrigerant flowing through the distribution pipe is unevenly distributed into the first distributer and the second distributer when the absolute value of the difference is larger than the threshold value and, increase the degree of subcooling at the outlet of the heat exchanger of whichever one of the first distributer and the second distributer of which the capacity is higher when the controller determines the refrigerant flowing through the distribution pipe is unevenly distributed.

2. The refrigeration cycle apparatus of claim 1, wherein, when the controller determines the refrigerant flowing through the distribution pipe is unevenly distributed into the first distributer and the second distributer, the controller increases the degree of subcooling at the outlet of the heat exchanger of whichever one of the first distributer and the second distributer has a larger difference between the suction air temperature and the heat medium temperature in the connected utilization unit.

3. The refrigeration cycle apparatus of claim 1, wherein, when the controller determines the refrigerant flowing through the distribution pipe is unevenly distributed into the first distributer and the second distributer, the controller increases the degree of subcooling at the outlet of the heat exchanger of whichever one of the first distributer and the second distributer has a smaller difference between a set temperature and the heat medium temperature in the connected utilization unit.

4. The refrigeration cycle apparatus of claim 1, wherein the controller is configured to control the degree of subcooling at the outlet of the heat exchanger to equal a control target value, and to determine whether an unevenness exists between the capacity of the first distributer and the capacity of the second distributer, and when the unevenness is determined to exist, to change the control target value of one of the first distributer and the second distributer based on a determination that the distribution pipe unevenly distributes the refrigerant into the first distributer and the second distributer.

5. The refrigeration cycle apparatus of claim 4, wherein, when the unevenness is determined to exist, the controller is configured to increase, by a preset value, the control target value of one of the first distributer and the second distributer of which the capacity is higher.

6. The refrigeration cycle apparatus of claim 4, wherein, when the unevenness is determined to exist, the controller is configured to increase, in accordance with a difference between the capacity of the first distributer and the capacity of the second distributer, the control target value of one of the first distributer and the second distributer of which the capacity is higher.

7. The refrigeration cycle apparatus of claim 4, wherein, when the distribution pipe distributes two-phase gas-liquid refrigerant, the controller is configured to determine whether the unevenness exists.

8. The refrigeration cycle apparatus of claim 7, wherein, when the first distributer and the second distributer are in a mixed operation mode in which the plurality of connected utilization units perform both a heating operation and a cooling operation and a load of the utilization units performing the cooling operation is greater than a load of the utilization units performing the heating operation, the controller is configured to determine whether the unevenness exists.

* * * * *